US010234247B2

(12) United States Patent
Beine et al.

(10) Patent No.: US 10,234,247 B2
(45) Date of Patent: Mar. 19, 2019

(54) PROJECTILE WEAPON TRAINING APPARATUS USING VISUAL DISPLAY TO DETERMINE TARGETING, ACCURACY, AND/OR REACTION TIMING

(71) Applicant: LATTS, LLC, Lancaster, KY (US)

(72) Inventors: Robert Leon Beine, Lancaster, KY (US); Robert Barksdale Beine, Lancaster, KY (US)

(73) Assignee: LATTS, LLC, Lancaster, KY (US)

( * ) Notice: Subject to any disclaimer, the term of this patent is extended or adjusted under 35 U.S.C. 154(b) by 500 days.

(21) Appl. No.: 14/886,827

(22) Filed: Oct. 19, 2015

(65) Prior Publication Data

US 2016/0138895 A1 May 19, 2016

Related U.S. Application Data

(60) Provisional application No. 62/079,839, filed on Nov. 14, 2014.

(51) Int. Cl.
*F41J 5/02* (2006.01)
*F41J 5/04* (2006.01)
(Continued)

(52) U.S. Cl.
CPC ..... *F41J 5/02* (2013.01); *F41J 5/041* (2013.01); *F41J 5/044* (2013.01); *F41J 5/056* (2013.01);
(Continued)

(58) Field of Classification Search
CPC ..... F41J 5/02; F41J 5/041; F41J 5/044; F41J 5/056; F41J 5/10; F41J 5/14; F41J 9/14; F41G 3/26; F41G 3/2605; F41G 3/2611; F41G 3/2627; F41G 3/2638; F41G 3/2644; F41A 33/00; F41A 33/02; F41A 33/04; F41A 33/06; F41A 33/08
See application file for complete search history.

(56) References Cited

U.S. PATENT DOCUMENTS 4,604,668 A * 8/1986 Lemelson ..... H04N 1/00397 348/384.1
8,506,369 B2 * 8/2013 Grant ..... A63F 13/06 463/2

(Continued)

*Primary Examiner* — Timothy A Musselman
(74) *Attorney, Agent, or Firm* — King & Schickli, PLLC

(57) ABSTRACT

This apparatus offers multiple training scenarios which designates the targets to be hit and evaluates response. The apparatus assists in the evaluation and training of a shooter using multiple scenarios, detection of target strikes, timing, accuracy, and threat assessment. The system may be used with unmodified weapons and may not require attachments to weapon or shooter. The light source(s) in this apparatus may include visible lasers, focused light emitters, video or image projectors. The shooter may use live ammunition, and the weapon may be fired and operated independently of the control system. Hit detection on the targets may use vibration, accelerometer, acoustic, optical or thermal sensors that respond to projectile strikes on the designated target(s). If the specific location of the strike on the target is desired, nested targets and multiple sensor triangulation calculations may be used. This system designates which targets to shoot, when to fire, and evaluates the results.

13 Claims, 9 Drawing Sheets

(51) Int. Cl.

| | |
|---|---|
| ***F41J 5/044*** | (2006.01) |
| ***F41J 5/056*** | (2006.01) |
| ***F41J 5/10*** | (2006.01) |
| ***F41J 5/14*** | (2006.01) |
| ***F41J 9/14*** | (2006.01) |

(52) U.S. Cl.
CPC . *F41J 5/10* (2013.01); *F41J 5/14* (2013.01); *F41J 9/14* (2013.01)

(56) References Cited

U.S. PATENT DOCUMENTS

| | | | | |
|---|---|---|---|---|
| 8,523,185 | B1 * | 9/2013 | Gilbreath | F41J 5/056 273/348 |
| 2006/0170421 | A1 * | 8/2006 | Benz | G01R 33/563 324/309 |
| 2007/0035528 | A1 * | 2/2007 | Hodge | B63G 13/00 345/174 |
| 2008/0213732 | A1 * | 9/2008 | Manard | F41A 33/00 434/16 |
| 2015/0092266 | A1 * | 4/2015 | Yeremian | G03B 21/10 359/443 |
| 2015/0198420 | A1 * | 7/2015 | Foege | F41J 9/14 273/317.1 |
| 2016/0252326 | A1 * | 9/2016 | Jones | G09B 9/003 434/19 |

* cited by examiner

PROJECTILE WEAPON TRAINING APPARATUS USING VISUAL DISPLAY TO DETERMINE TARGETING, ACCURACY, AND/OR REACTION TIMING

This application claims priority to U.S. PROVISIONAL Application Ser. No. 62/079,839, filed Nov. 14, 2014, the disclosure of which is hereby incorporated by reference.

TECHNICAL FIELD

This invention generally relates to a system for projectile weapons training, and more particularly to a system for detecting impact of said projectile weapons.

BACKGROUND OF THE INVENTION

Projectile weapon training systems, such as weapon firing simulation systems, are generally used to provide weapon training to a trainee. Generally, the trainee is given a modified weapon including a laser light used to engage a target or simulation. The purpose is to allow the trainee to practice his or her targeting skills with the projectile weapon without discharging said weapon. While this may provide an element of safety to the training scenario, it does not provide a realistic experience for the trainee which replicates the use of an unmodified weapon. The trainee is therefore not able to replicate the targeting experience which would be utilized in the context outside the training system.

Alternately, traditional targeting ranges may utilize a non-responsive and/or non-interactive target, such as a paper or plastic bullseye, which the trainee may utilize in training with an unmodified or "live" projectile weapon such as a gun. These systems, including traditional gun ranges, offer the trainee a more realistic experience in terms of the discharge of the projectile weapon (as unmodified, conventional, or "live" weapons are often used). However, they are unable to accurately simulate realistic surroundings that may be present in the case of a weapon discharge outside the context of the targeting range. Additionally, traditional targeting ranges are limited in the feedback available to a trainee, such as temporal recognition of an accurate contact with a target.

Accordingly, a need has been identified for a targeting system which addresses these and other shortcomings of the trainee's training experience.

SUMMARY OF THE INVENTION

An objective of the present invention is to provide an improved interactive targeting system for use with a projectile weapon firing a projectile, said system providing feedback to a user of the system.

In one embodiment, a targeting system is provided for use with a projectile weapon for firing a projectile, wherein the system comprises a light emitter for projecting a light, said light designating a valid target for the projectile, a first sensor for detecting an impact of the projectile, a controller for receiving feedback from a user and for controlling the light emitter, and a processor for receiving a first input from the first sensor and calculating an output relating to the impact of the projectile.

In one aspect, the light emitter may comprise a laser and the light comprises a focused light beam. In another aspect, the light emitter may comprise a video projector. In such an aspect, the light may comprise an image, a video, or both.

In another aspect, the light emitter may be adapted for projecting a second light upon the target, said second light designating an invalid target. In such an aspect, the output may include a measure of the user's accuracy with respect to hitting a valid target with the projectile and avoiding hitting an invalid target with the projectile.

The first sensor for detecting impact of the projectile may comprise one of any number of types of sensors. For example, the first sensor may comprise a piezoelectric sensor. The first sensor may comprise a sonic sensor. In a further aspect of the system, the first sensor may comprise a video camera. In one aspect, the first sensor may comprise a first conductor and a second conductor, and wherein impact of the projectile is detected by contact of the first conductor with the second conductor. In such an embodiment, the first conductor may be located within the second conductor. The system may further include a multi-vibrator circuit for causing a stable single pulse electronic signal as the first input from the first sensor to the processor.

The system may further include a plurality of second sensors for detecting the impact of the projectile and for generating a plurality of second inputs for the processor, and the processor may be adapted to use the first input and the second inputs to locate a position of the impact of the projectile.

The system may include one or more position sensors for sensing a position of the user. The system may further include one or more alerts for alerting the user that the user has remained in a first position beyond a predetermined period of time. A timer may be provided for measuring the predetermined period of time. The system may include a processor for receiving a signal from the position sensor and for triggering the alert upon expiration of the predetermined period of time in the event that the user has remained in the first position. The alert may include a bumper for contacting the user. In another aspect, the alert may comprise an auditory alarm.

In another aspect, the system may include a target receiver upon which the light from the light emitter is projected. The target receiver may comprise a solid surface for receiving the projectile. In another embodiment, the target receiver may comprise a fluid surface through which the projectile may pass. In a further aspect, the target receiver may comprise a visible vapor. The target receiver may comprise a foreground surface with at least one aperture and at least one background surface generally aligning with the aperture. In such an embodiment, the sensor may be associated with the at least one background surface for detecting the impact of the projectile with the background surface.

The light projected by the light emitter may comprise an image, and the system may further comprise an image recorder for recording said image. The image may comprise a moving object, and the system may further comprise a second sensor for sensing a virtual impact of said moving object.

In one aspect of the invention, the weapon may not be in communication with the targeting system.

In another embodiment of the present invention, a method is disclosed for measuring accuracy of a user's use of a projectile. The method may include the steps of providing a valid target designated for impact from the projectile, providing an invalid target designated for avoiding impact from the projectile, sensing a location of an impact of the projectile, and determining a cognitive response of the user based on a calculated accuracy of the user creating an impact of the projectile near the valid target and avoiding an impact of the projectile near the invalid target.

In one aspect, the providing steps may comprise projecting a first image of the valid target and a second image of the invalid target. The method may further include the step of recording at least one of the first or second images.

The determining step may further comprise calculating a time between the step of providing the valid target and the sensed impact of the projectile.

The projectile may be fired from a weapon, and the weapon may be an unmodified weapon. For purposes of this disclosure, the term "unmodified weapon" means a weapon that is not adapted to communicate with the targeting system, and which fires a projectile.

The sensing may comprise providing two conductors associated with at least one of the targets, and wherein contact between the two conductors indicates the impact of the projectile.

The method may further include the step of providing a targeting surface upon which the valid target and the invalid targeted are projected. The targeting surface may comprise a fluid. In another aspect, the targeting surface may comprise a visible mist. In still a further aspect, the method may include the step of providing a second surface between the user and the targeting surface, wherein the second surface includes at least one aperture and the targeting surface is aligned with the aperture.

In yet another embodiment of the present invention, a targeting system is disclosed for use with a plurality of projectile weapons for firing a projectile, each of said projectile weapons associated with one of a plurality of users. The system may include at least one projector for projecting a plurality of valid targets, each valid target designated for one of the plurality of users, a first sensor for detecting a first impact of a projectile from a first of the plurality of users, a second sensor for detecting a second impact of a projectile from a second of the plurality of users, a controller for receiving feedback from at least one of the plurality of users and for controlling the at least one projector, and a processor for receiving a first input from the first sensor and a second input from the second sensor, and for determining a characteristic of the first impact relative to the second impact.

The characteristic may include a time between the projection of one of the valid targets and one of the first or second impacts. In another aspect, the characteristic may include a comparison of a distance between a valid target for the first user and the first impact with a distance between a valid target for the second user and the second impact.

DETAILED DESCRIPTION OF THE INVENTION

Figure 1:
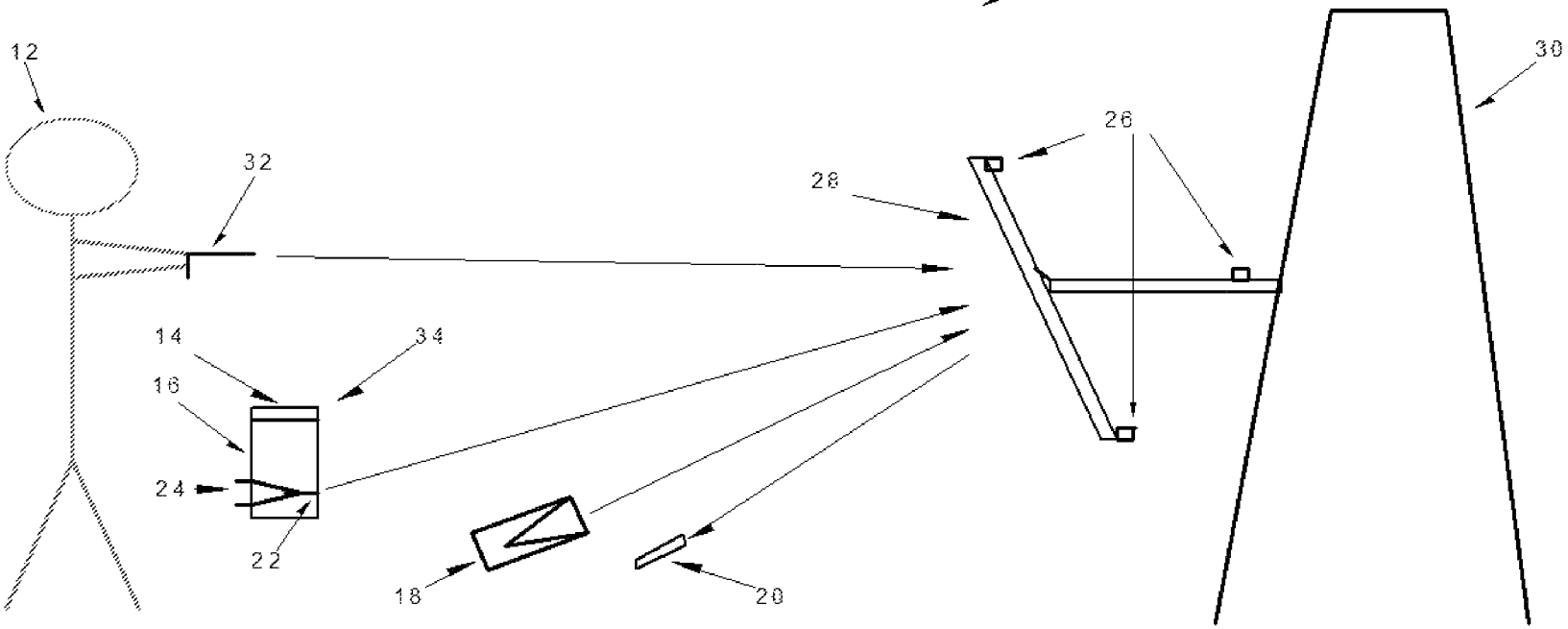
FIG. 1 is a schematic of the projectile weapon training system of the present invention.

The apparatus described provides for an integrated system 10 that may create various training scenarios. The system 10 may use a visual display to determine targeting, consisting of a control device which may be located at or near the shooter or trainer and one or more detection devices generally mounted on or near the targets. FIG. 1 shows a typical placement of a shooter 12, using the system 10, wherein the system 10 may include one or more apparatus components including a user display 14, a controller 16, a projector 18, a recording device such as a camera 20, a laser 22, a laser-adjust mechanism 24, and a power supply (e.g. portable battery or fixed power unit(s)), as well as one or more sensors 26 and one or more targets 28. The target(s) 28 and/or the sensor(s) 26 may be associated with a support 30, such as a backstop.

The system 10 may allow the use of one or more unmodified weapons 32 and standard ammunition for firearms and other projectile weapons. In the context of the present disclosure, the term "unmodified weapon" refers to a conventional or "live ammunition" weapon that is only adapted to communicate with the system 10 via the strike of the projectile (e.g. the ammunition). These unmodified weapons may include firearms, bows, crossbows, and other projectile weapons, and the projectile may trigger a detector(s) for later reporting the outcome/results of the shooter's actions.

Visual projections from the system 10 may be used to initiate a shooter response. These visual projections may be in the form of a visible laser, focused light emission, image, or video displayed on the target 28 from one or more light emitters, such as from the laser 22 and/or the projector 18. The visual projection(s) may be projected upon the target 28 for visualization by the shooter 12. In another aspect, a sonic initiation may be used to trigger a shooter response, such as from an audio source (e.g. a speaker, not shown).

Response detection methods may include one or more sensors 26 near or attached to target(s) for recording strikes on the target(s). The controller 16 may be adapted to vary target selection, timing, and output based on target strike detections. Result information from various sensor techniques may be received by the system 10, merged with one or more program parameters selected and reported, which may include digital displays, number and location of projectile target strikes, and timing data related to shooter response for multiple programs. In one aspect, results from the system may be exported to a target external to the system. For example, the results may be exported to a computer, tablet, smartphone, mobile application, or any other device or receiver capable of displaying the results to the user.

The system 10 facilitates the shooter's learning of targeting, speed, accuracy, and judgment of the use of a projectile weapon. The shooter 12 and/or an instructor or evaluator may input parameters to the controller 16 for a desired shooter scenario. In one embodiment, the system 10 may begin a program of lights or projections that designates both threat and nonthreat targets in a timed manner, with strike timing on the target recorded and displayed as an output. Detection devices or light emitting devices may vary depending on the targeting devices or scenario chosen at setup by trainer or shooter (see, e.g., FIG. 6).

With further reference to FIG. 1, the system 10 may include the user display 14 and the controller 16, which may include a computer and/or microprocessor, manual/electronic input controls, output display and/or data storage device(s), wired or wireless communication module(s), and/or power supply. In one aspect, the controller 16 may be adapted to direct the shooter 12 to one or more correct targets, initiate a weapon response, and evaluate the accuracy and timing allowed for and utilized by the shooter 12.

The system 10 may further include one or more light emitters adapted to emit visibly light of an intensity sufficient to be projected to the target and observed by the shooter. The light emitter(s) may comprise the projector 18 and/or the laser 22. The projector 18 may create a visual target field upon the target 28. One or more of the light emitters may project a laser or light dot, an image, or a motion video projection upon the target to create the visual target field. The laser 22 may be adapted to direct the shooter to a given target within the target field. In one example, one or more of the projector 18 and the laser 22 may emit one of various visible wavelengths, colors, or projections, each of which may be adapted to elicit a varying shooter response. For example, a projection of the color green, either from the projector 18 or the laser 22, may elicit a "shoot" response from the shooter, while a projection of the color red from the projector 18 or the laser 22 may elicit a "do not shoot" response. The light emitters may be mechanically and/or electrically adjustable for placement of the emitted light upon a given target. For example, the laser adjust mechanism 24 may be provided in order to adjust the horizontal and/or vertical position of the laser 22. The laser adjust mechanism may take any form such as a manual control (e.g. a knob, a lever, or dial) or an electronic controller associated with the overall system controller 16. The controller 16 may be adapted to control one or more of the projector 18 and the laser 22 for accurate presentation of the visible light upon the given target.

The user display 14 may provide an interactive interface between the shooter 12 or a trainer and the system 10. The user display may include an analog or digital feedback display for communicating to the shooter 12 instructions and/or results from the system 10. The shooter 12 or trainer may input instructions and/or preprogrammed scenarios into the system 10 for enacting a training exercise. In one instance, the user display may comprise one or more interactive elements such as buttons, as may be associated with a keyboard, and/or screen. The screen may be a touch screen.

In one aspect, one or more of the various elements of the system 10 may be contained within or connected to a control system housing 34. For example, in the embodiment illustrated in FIG. 1, the control system housing 34 includes the user display 14, the controller 16, the laser 22, and the laser-adjust mechanism 24.

One or more targets 28, suitable for the impact of one or more projectiles that may be used by the shooter 12, may be placed in the shooter's range of fire. The target(s) 28 may be adapted to reflect the light from the light emitter(s) back to the shooter for use during a training scenario.

The system 10 may further include means for sensing an impact of a projectile with the target 28, such as one or more strike detecting devices. For example, sensors 26 may be attached to or in communication with the target 26 for sensing an impact. The sensors 26 may comprise vibration and/or sonic sensors.

Figure 2A:
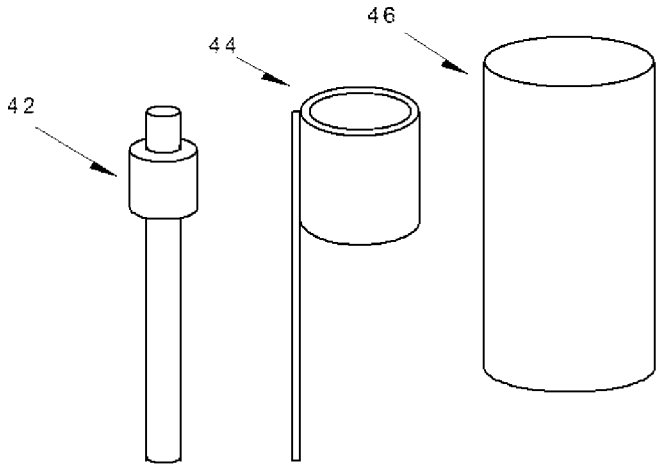
FIGS. 2A and 2B illustrate a first sensor of the present invention.
Figure 2B:
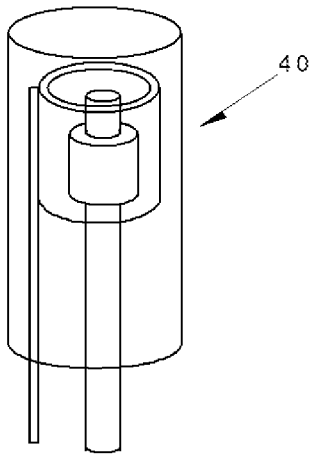
Figure 3A:
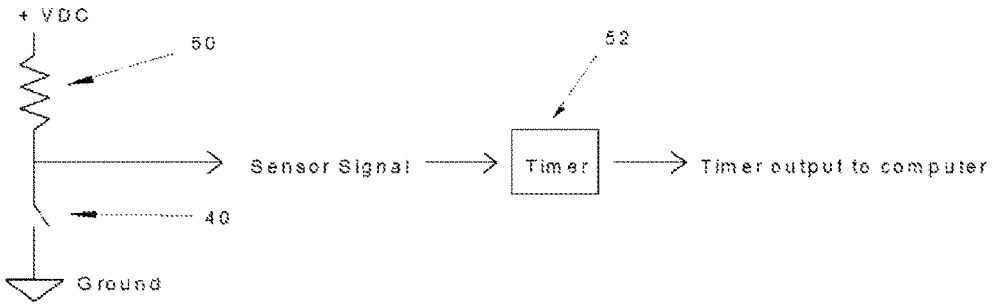
FIG. 3A is a schematic of the electrical connection of the sensor of FIGS. 2A and 2B and a control timer associated therewith.

In one example, sensors 26 may comprise mechanical sensors 40 such as those illustrated in FIG. 2. The mechanical sensors may be attached to the target 28 magnetically or mechanically. These mechanical sensors 40 may include two electrically conductive components making mechanical and electrical contact caused by vibrations resulting from a projectile striking the target 28. As illustrated, the mechanical sensor 40 may include an inner clapper 42, an outer bell 44, and an enclosure 46 at least partially surrounding the clapper and the bell. The outer bell 44 and/or the inner clapper 42 may be adapted for movement associated with the strike of a projectile on the target. For example, the inner clapper 42 may be fixed and the outer bell 44 may be spring-mounted to allow for relative movement with respect to the fixed inner clapper 42. Of course, the inner clapper 42 may be adapted for movement and the outer bell 44 may be fixed in place. One of the conductive clapper 42 and the bell 44 may be connected to a positive voltage, such as through a pull-up resistor 50, while the other may be connected to electrical ground, as is illustrated in FIG. 3A. Contact between the two electrically conductive components such as the clapper 42 and the bell 44 may close a circuit between the positive voltage and ground to output a signal. This signal may be sent to a timer 52, which may be associated with the controller 16, or may be placed between the sensor 40 and the controller 16.

Figure 3B:
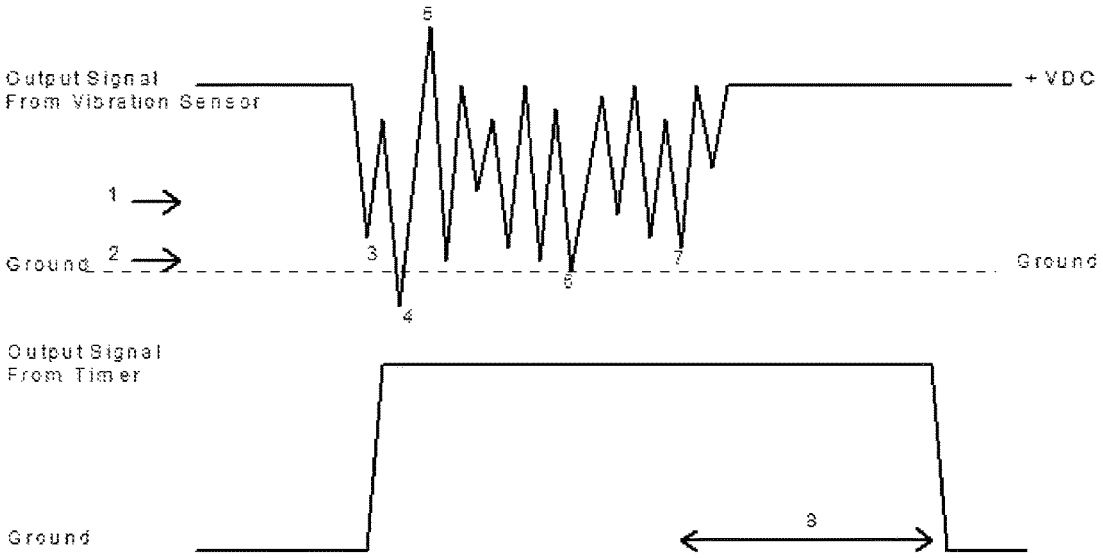
FIG. 3B illustrates an electrical output conversion from the control timer of FIG. 3A.

With further reference to FIG. 3B, contact between conductors within a mechanical sensor 40, such as between the clapper 42 and the bell 44, may occur multiple times as a result of a single strike. While this contact may be used to confirm a hit on the target 28, this contact may create an electrical "noisy" environment with many different voltage or amperage peaks and valleys (ringing, or spikes). Long lengths of wire from the sensor 40 to the controller 16 may also create capacitance or invalid digital voltage signals. A timer with a wider voltage trigger input response may improve strike detection.

Reduction of a false indication of multiple target hits may be accomplished by providing an electronic mono-stable multi-vibrator such as a NE555, NE556, or similar devices placed in electrical series between the mechanical sensor 40 and digital input of a microprocessor/computer associated with controller 16, as illustrated in FIG. 3B. The timer may be designed to trigger a single timed output even in the event of input "noise" or invalid digital voltage thus providing a stable digital signal output to the controller 16. As illustrated, a triggering event (such as a first contact between the clapper and the bell) may trigger create sufficient voltage to trigger a single stable output from the timer. The timer may continue outputting a stable output for a period of time until no further change in voltage from the mechanical sensor 40 is sufficient to trigger the timer, and/or for a preset time after the last triggering event from the mechanical sensor 40 sufficient to trigger the timer. The electronic timer may allow for more input voltage variation from the strike than common digital inputs, and may output a stable single pulse trigger without repeat triggering from the sensor. Timer output remains stable until a set time after the last strike vibration pulse is detected. This is especially valuable on rapid same target strikes (i.e. "double tap"). A vibration dampener associated with the target 28 may further reduce the "noise" associated with this type of mechanical sensor.

As illustrated in FIG. 3B, point 1 represents a voltage drop needed to trigger the timer. Point 2 represents a voltage drop needed to trigger a digital low input. Point 3 illustrates a voltage that triggers the timer but not the digital input. Point 4 illustrates a voltage which triggers both the timer and the digital input. It is noted, however, that a negative voltage may damage the digital input. Point 5 represents an over-voltage, which may also damage an input. Point 6 illustrates another example of a trigger signal, indicating that a single event may trigger multiple signals. Point 7 illustrates the final time during the given sequence in which the timer is triggered. Range 8 illustrates a stable output signal that may continue for a preset time after the final trigger of the input.

In a further aspect, a two or three axis accelerometer may be used to detect the target acceleration caused by a projectile strike and processed in a manner similar to the vibration detector. The sensor(s) 26 may be piezoelectric in nature.

Figure 4:
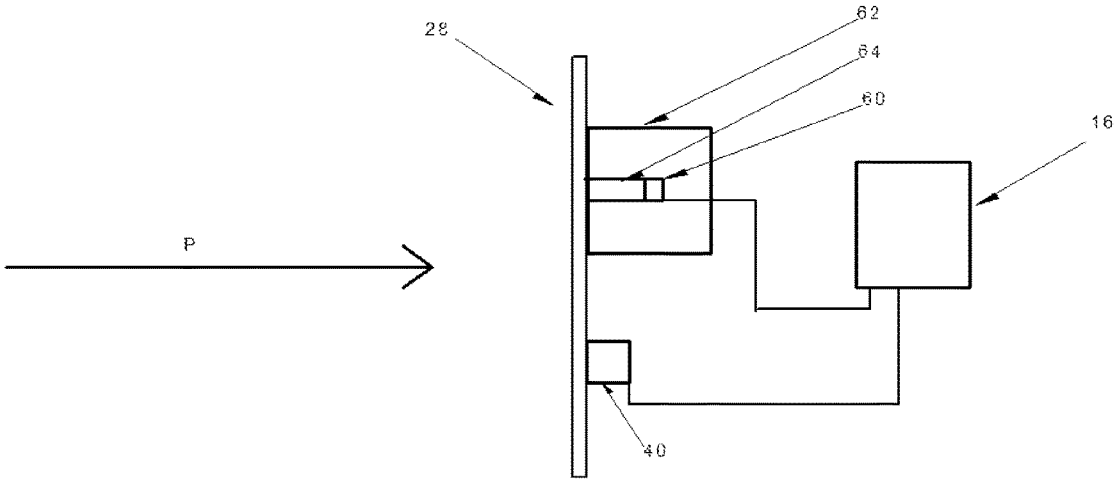
FIG. 4 is a side view of one embodiment of a target of the system of the present invention.

In another embodiment, one or more of the sensors 26 associated with the target 28 may comprise a sonic sensor 60, as shown in FIG. 4. The sonic sensor may comprise a microphone or other sonic detector capable of sensing a sound wave, and may be in communication with the controller 16. While communication between the sonic sensor 60 and the controller 16 is illustrated as being a wired connection, it is understood that the communication between these elements may be wireless.

In one aspect, the sonic sensor 60 may be at least partially enclosed in an acoustic foam 62 in order to insulate outside sound from interfering with the sonic sensor 60. As illustrated in FIG. 4, the acoustic foam 62 may surround the sonic sensor 60, and the acoustic foam may be connected to the target 28. The sonic sensor 60 may be separated from the target 28 by a small hollow cavity 64 within the acoustic foam 62. This cavity 64 may create a path of travel between the target 28 and the sonic sensor 60 for the travel of sound waves created when a projectile P hits the target 28. As shown in FIG. 4, one or more sonic sensors 60 may be used in combination with one or more mechanical sensors 40.

Figure 5:
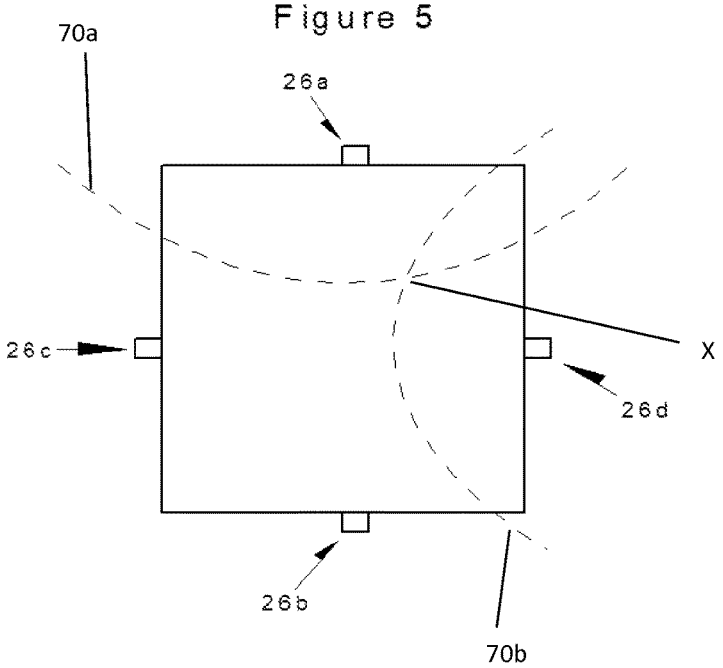
FIG. 5 is a front view of a second embodiment of a target of the system of the present invention.

With reference to FIG. 5, an aspect of the invention is disclosed, wherein multiple sensors may be associated with opposing portions of the target 28 in order to accurately locate the position of a projectile striking the target 28. In this aspect, sensors 26*a* and 26*b* may be placed along opposite portions of the target, and sensors 26*c*, and 26*d* may be placed along opposite portions of the target. A first timing differential may be calculated between a detected impact at sensor 26*a* and sensor 26*b*. A first plot 70*a* of all points along the target 28 which may account for this first timing differential may be calculated. Similarly, a second timing differential may be calculated between a detected impact at sensor 26*c* and 26*d*. A second plot 70*b* of all points along the target 28 which may account for this second timing differential may be calculated. The point X at which the first plot 70*a* and the second plot 70*b* intersect may be considered the location of the impact. It is noted that if sensor 26*a* is triggered before sensor 26*b*, the top hyperbolic curve of first plot 70*a* is used as illustrated. If sensor 26*b* is triggered before sensor 26*a*, then a lower hyperbolic curve, which is essentially a mirror image of the upper curve, is used and similar for left and right hyperbolic curves for sensor 26*c* and 26*d*. This technique may also be applicable for lower velocity projectile(s), (arrows etc.) using a permeable target with a lower solid vibration propagation speed, even darts on a cork board. It is also noted that calculations of strike location may be accomplished through other methods such as look-up tables associated with a given material, or any other mathematical calculation.

Time and location of projectile strike on a large target may be recorded by using paired sonic sensors 60 on opposite sides of the target, detecting the sound wave sensor time differential generated by the projectile passage through the air in front of the target.

A second technique may detect vibrations in the solid target material caused by an impact of the projectile on a solid target by using high speed sensors (for example piezoelectric) attached to the edge of the target. Vibration propagation from the strike moves though the target material to the sensors attached near the edges of the target. For example, steel has a wave propagation speed of approximately 20,000 ft/s, the sensors mounted to the steel target provide data that allows triangulation and calculations in a similar fashion to an air sonic detector. Sensor data is transmitted back to the computer for calculations and data storage on strike locations. Calculations may include using the strike time differentials between multiple pairs of sensors using hyperbolic intersections and other equations, much as with the sonic sensors.

Figure 6:
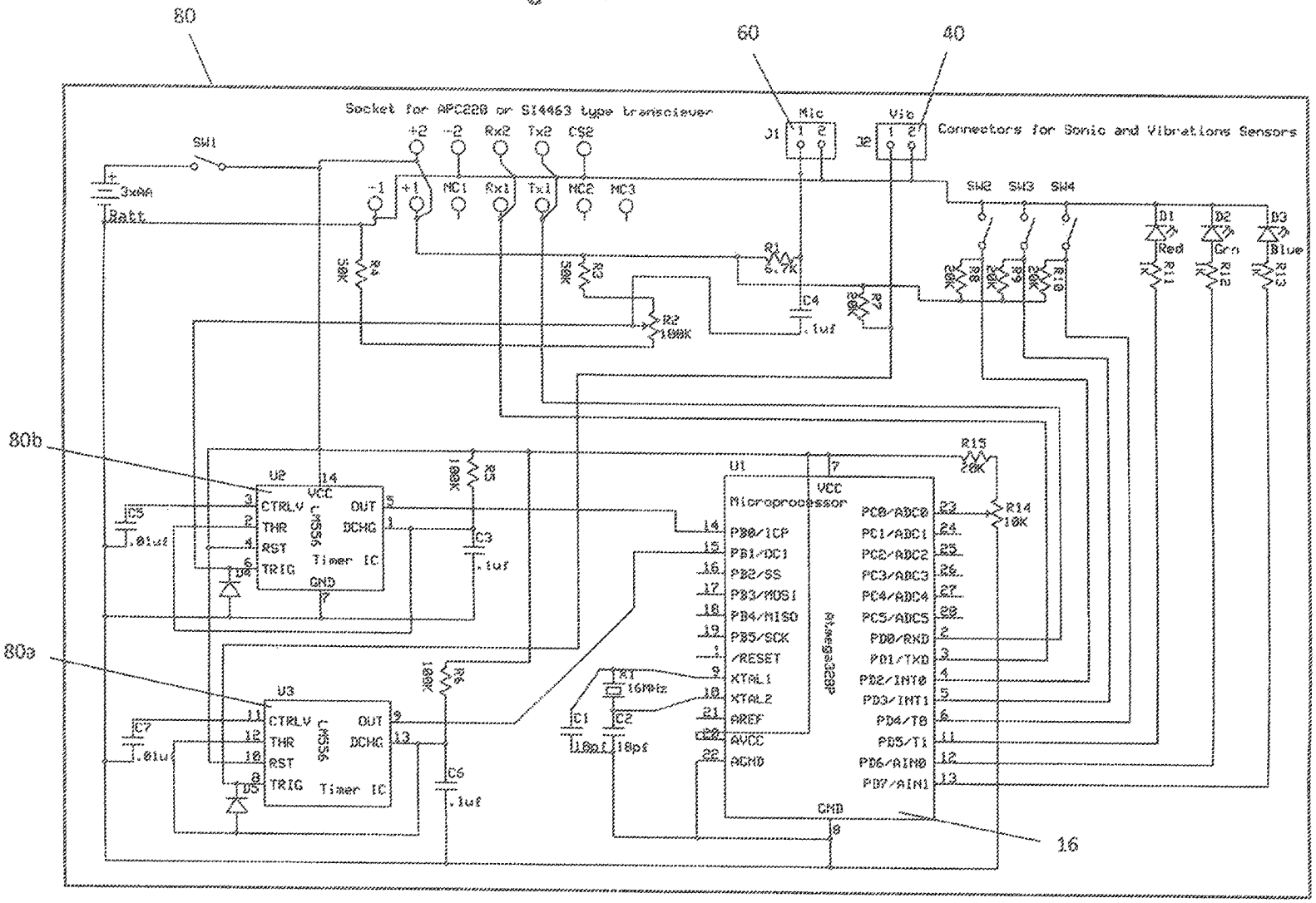
FIG. 6 is a circuit diagram of the control of the embodiment of FIG. 4.

In some instances, target strike detection requires rapid and accurate detection of each strike during repeated fire on the same target (e.g. in the context of a "double tap"). Vibration detection may have extended vibration on poorly secured targets causing false multiple reads of a single strike. Sonic detectors may occasionally detect an invalid strike on a nearby target, thereby creating a false detection of a strike. Accordingly, the use of at least one vibration or mechanical sensor 40 and at least one sonic sensor 60 (as illustrated in FIG. 4), may resolve issues created by each type of sensor individually. As illustrated in FIG. 6, a sensor control circuit 80 may be provided for accounting for and combining the signals generated by both types of sensors. The use of mechanical sensor 40 in conjunction with a timer 52 as described herein has improved sensitivity over direct digital input to microprocessor by increasing voltage range for trigger and presenting a clean signal over a certain time interval to the controller 16. In the context of the sensor control circuit 80 of FIG. 6, a first timer control circuit 82*a* may receive the signal from the mechanical sensor 40 and output the clean signal to the controller 16. Similarly, sonic sensor 60 may be used, and the resulting sonic sensor signal may be filtered through a capacitor into a second timer control circuit 82*b* for optimizing sensitivity versus noise rejection and may present a clean signal to the microprocessor. Signal diodes on the timer control circuits 82*a*, 82*b* may prevent damaging negative voltage spikes. The controller 16 may then determine (via hardware or software) when a signal has been received by both the mechanical sensor 40 and the sonic sensor 60 for an accurate determination of a strike.

In another aspect of the present invention, the a strike detector may be provided in the form of an image recording device, such as a camera 20, as illustrated in FIG. 1. The camera 20 may comprise a mid-infrared camera, which may have a thermal sensitivity from 100 to 1000 degrees Centigrade. The camera 20 may be focused on the target 28 and may be adapted to record thermal emissions associated with a short burst of heat energy caused at the point of contact of a projectile striking the target 28. The infrared results may integrate with the type of target field being used, be it visual projection, motion image, or static target, for later evaluation of the results in each scenario. The use of a camera 20 may be particularly useful in the context of the target 28 comprising a liquid film or mist as described below.

The target 28 may comprise one or more of any suitable type of target desired for a given training scenario. In one aspect, the target 28 may comprise a non-penetrable solid material for vibration and/or sonic detection of projectile impact. In another aspect, the target 28 may comprise a reflective target for reflecting an image or video projection.

Figure 7:
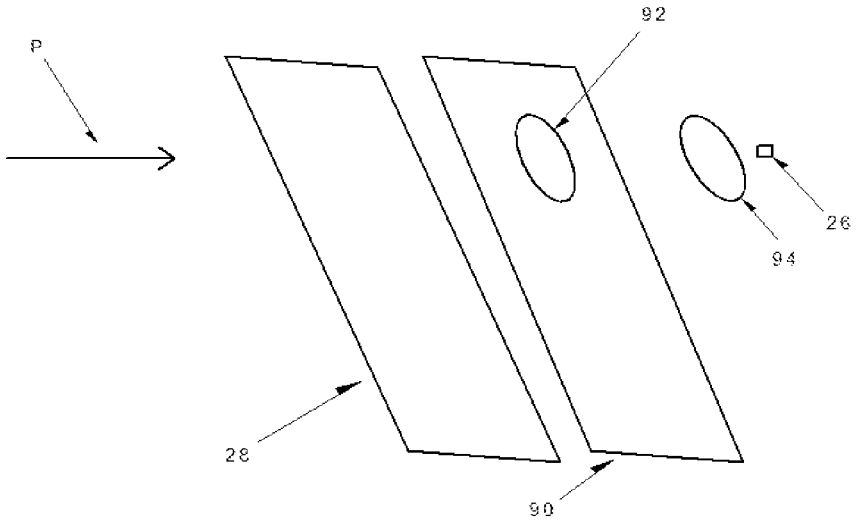
FIG. 7 is a an exploded view of a further embodiment of a target of the system of the present invention.

With reference to FIG. 7, the target 28 may comprise multilayer target including a foreground target 90, which may include one or more holes or apertures 92. These holes or apertures 92 may allow a projectile P to pass therethrough to one or more second background target(s) 94. One or more of the sensors 26 may be connected to or associated with the background target(s) 94 for sensing an impact associated with the background target(s) 94. One or more sensors (not pictured) may be associated with the foreground target 90 for detecting an impact thereto.

The foreground target 90 may be at least partially covered with a penetrable screen 96. The screen 96 may comprise a projection material for image or video display and/or hiding a location of the background target(s) 94. Only projectiles passing through the holes or apertures 92 may strike the background target(s) 94. The light emitter(s) may place a target or a threat on an area of the screen 96 covering the background target 94, thus allowing differentiation between a desired shooter response (e.g. impact on the background target) and an undesired response (e.g. impact on the foreground target).

The system 10 may use simple fixed targets or complex mechanical targets, such as spring loaded or knockdown targets, etc. In one aspect, the foreground target 90 may comprise a complex mechanical target.

In a further embodiment, the target 28 may comprise a liquid film. For example, a surface such as a screen may be provided with a liquid dispenser (not pictured) thereabove, said dispenser adapted to trickle liquid along a surface of the screen. Alternately, there may be no screen present, and the liquid may be dispensed from the dispenser in the form of a curtain. A recycle reservoir and/or conduit may be provided for recycling liquid back to the liquid dispenser.

The system may be adapted to project a light, image, and/or video onto the liquid film during a training session. A projectile striking the liquid film will disrupt the liquid film, creating a temporarily visible impact site. This temporarily visible impact site may be detected by a recording device such as camera 20. The fluid may comprise one or more surfactants for uniformity, reflective color material for enhanced visibility, and/or other special effects chemicals.

In another embodiment, the target 28 may comprise a continuous spray or mist. This spray or mist may be provided by a nozzle or misting machine (not pictured). Similar to the liquid film, an impact from a projectile will disrupt the spray or mist, thereby creating a temporarily visible impact site that may be detected by a recording device such as a camera 20. The spray or mist may comprise aerosol agents, reflective color materials for enhanced visibility, and/or other special effect chemicals. In one aspect, these additives may be recycled to the spray or mist device.

The system 10 may be adapted to present one or more training scenarios to a shooter 12. The controller 16 may be adapted to integrate all aspects of each scenario for later output or review. The system allows the shooter or trainer to evaluate the session or scenario during or after the event and facilitates the shooter in gaining experience with the scenario(s) and record performance(s).

In one embodiment, the system 10 may designate one or more target(s) and evaluate shooter response by using custom software programs that record various aspects of the shooter's response including but not limited to the following: shooter reaction time(s), strike contacts on targets, non-threat targets and multiple strikes on same target such as "double tap," or cognitive discrimination of targets. Calculations of results may be recorded, interpreted, and distributed in common data output methods, i.e. USB, wifi, Bluetooth, etc. Software package may include multiple scenario parameters that can be modified by the trainer or designer.

In one embodiment, an alert signal, such as an audible tone or visual stimulation such as a flashing light, may be given to ready the shooter. After a random delay, a laser or focused light beam may be projected on a target. Upon seeing the light on the target, the shooter responds by drawing his/her weapon and shoots at the designated target. When the target is struck, a detection system associated with the target using, for example, an enhanced vibration detector, communicates with the controller 16 to confirm each hit on the target. The controller 16 turns off the laser 22 confirming the hit to shooter and continues the scenario. The time to draw and hit may be displayed for review, such as using a digital display or screen. Optionally, a "double tap" program may re-activate the laser on a previously hit target requiring multiple hits to finish scenario sequence.

Figure 8:
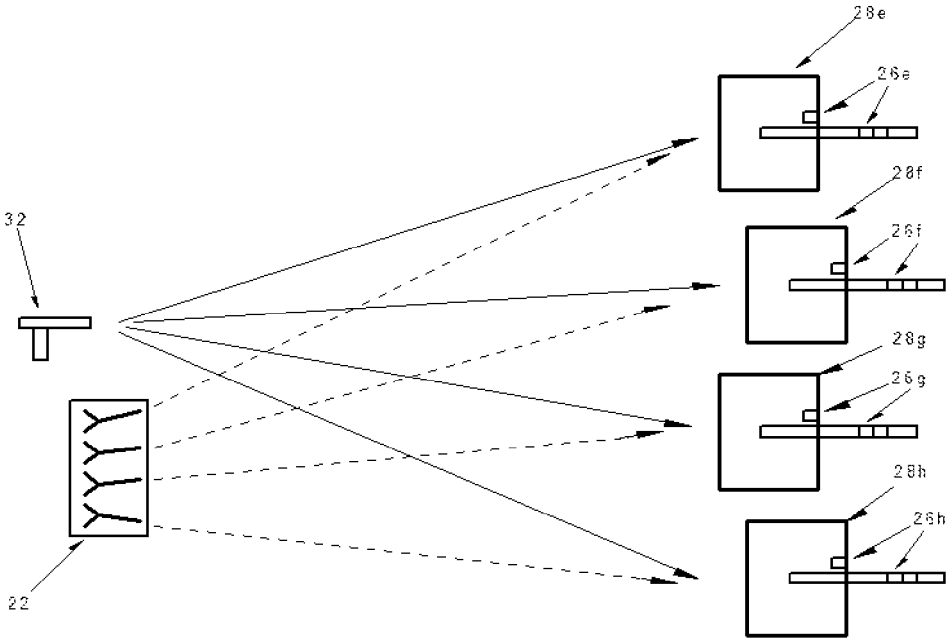
FIG. 8 is a top view of another embodiment of the weapon training system of the current invention.

With reference to FIG. 8, one embodiment of the disclosed system 10 uses multiple targets 28*e*, 28*f*, 28*g*, 28*h*. One or more sensors 26*e*, 26*f*, 26*g*, 26*f* may be associated with the respective targets. Separate visible light emitters (e.g. lasers 22) may be aimed at each target. After the system alerts the shooter to be ready, one or more of the lasers 22 may be activated for the shooter, emitting a light on one or more of the targets. The laser 22 may be deactivated by a strike on the respective target or programmed time out. Only hits on lighted target(s) may be detected as valid strikes. The number of targets, activations, and duration of time the lights are activated may be set prior to starting the sequence. Use of different colored visible light may also be used to designate targets to hit or cognitively avoid. Results may include number of targets activated, number of targets hit while activated, time to hit each target, and targets hit incorrectly.

Another embodiment may use the projector for projecting an image on the target 28. After alerting the shooter, such as via the alert signal, an image may be displayed on the target. As before, the strike data may be recorded for later review and evaluation. The image may be a threat, such as a man pointing a gun at the shooter, or non-threat, such as a mother holding a baby to create cognitive responses.

A further embodiment may use the projector 18 for projecting a video display on the target 28. A large target may display a video scene with a threat scenario. The shooter may be required to respond to a more complex shooting situation. Target strike detection may include time and location of strike on the screen target. Location on the screen may be accomplished by smaller targets nested in the larger screen target (e.g. the multilayer target), sensor triangulation using multiple sonic, piezoelectric or light sensors located around the target, or via a camera 20, such as an infrared video camera. The composite threat/thermal video movie may be reviewed for recreation of the shooter response. When used, video projection may provide a more realistic experience for the shooter for a better training scenario.

Figure 9:
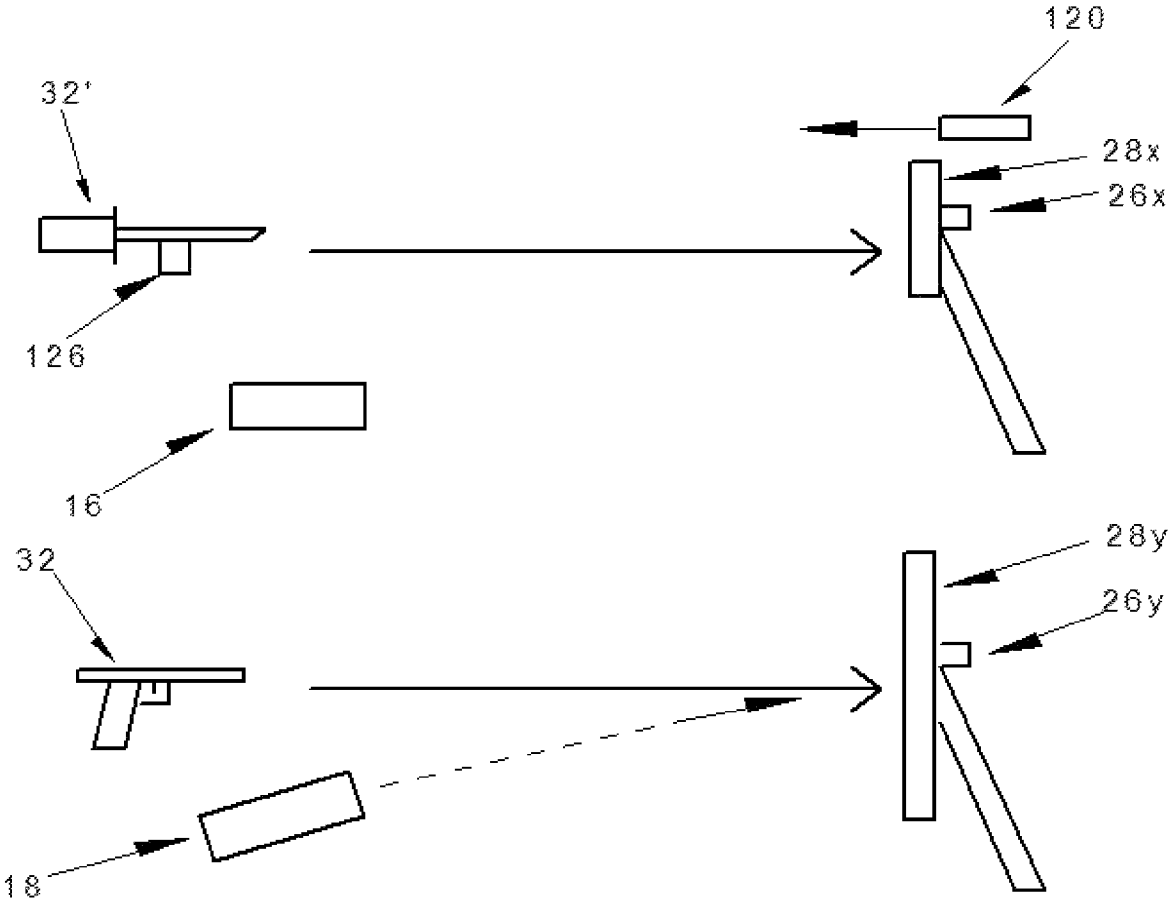
FIG. 9 is a schematic of a further embodiment of the weapon training system of the current invention.

With reference to FIG. 9, a further embodiment may include an integrated scenario with multiple users which may include a real time or recorded threat scenario used by the system 10 to initiate a shooter response. These may be one or more people as threats which are displayed to the shooter 12 via video from a different location, thus allowing for different cognitive responses from the shooter. For example, this may include a knife attack scenario, such as a projected video of a subject with a knife on the target.

As illustrated in FIG. 9, a first user with a first weapon 32' such as a knife, may use the first weapon 32' to attack the first target 28*x*. A first sensor 26*x* may sense an impact from the first weapon 32' on the first target 28*x*. In one embodiment, the first weapon 32' may include a sensor 126 for sensing said impact from the first weapon 32' on the first target 28*x*. The sensor 126 may comprise a mechanical contact, an optical sensor, a proximity detector, or other sensor capable of sensing a motion of and/or impact created by the first weapon 32'.

A camera 120 may be provided for recording the attack with the first weapon 32'. Video of the attack using the first weapon 32' may be displayed (either in real time or on a delay) on the second target 28*y*, such as via the projector 18. Thus, a real life situation (e.g. an attack with a knife) is created as a trigger for the shooter 12 to respond. Additionally, the time of the recorded attack from the first weapon 32' may provide a realistic response time for the shooter 12 to respond (i.e. before the first weapon 32' strikes the first target 28*x*).

In a further embodiment, the targeting system 10 may be designed for use with a plurality of shooters simultaneously, each with his or her own weapon. A projector or light emitter may be provided for directing each user to fire at a specific target. For instance, there may be a first target for the first user and a second target for the second user. The system may sense the impact of the shot(s) from one or a plurality of the users. This sensing of each impact may be performed by a single sensor or a plurality of sensors, either operating individually or on coordination with one another. The data from the sensors may be interpreted by the controller so as to compare the shots fired from each user. The result may be an integrated response from the input of a plurality of users. For instance, the controller may determine the timing associated with each user hitting a target so as to determine which user was faster at hitting his or her designated target. The processor may also calculate an accuracy of the placement of the fired shot. This accuracy may be used to determine which user was able to come closer to his or her designated target.

Figure 10:
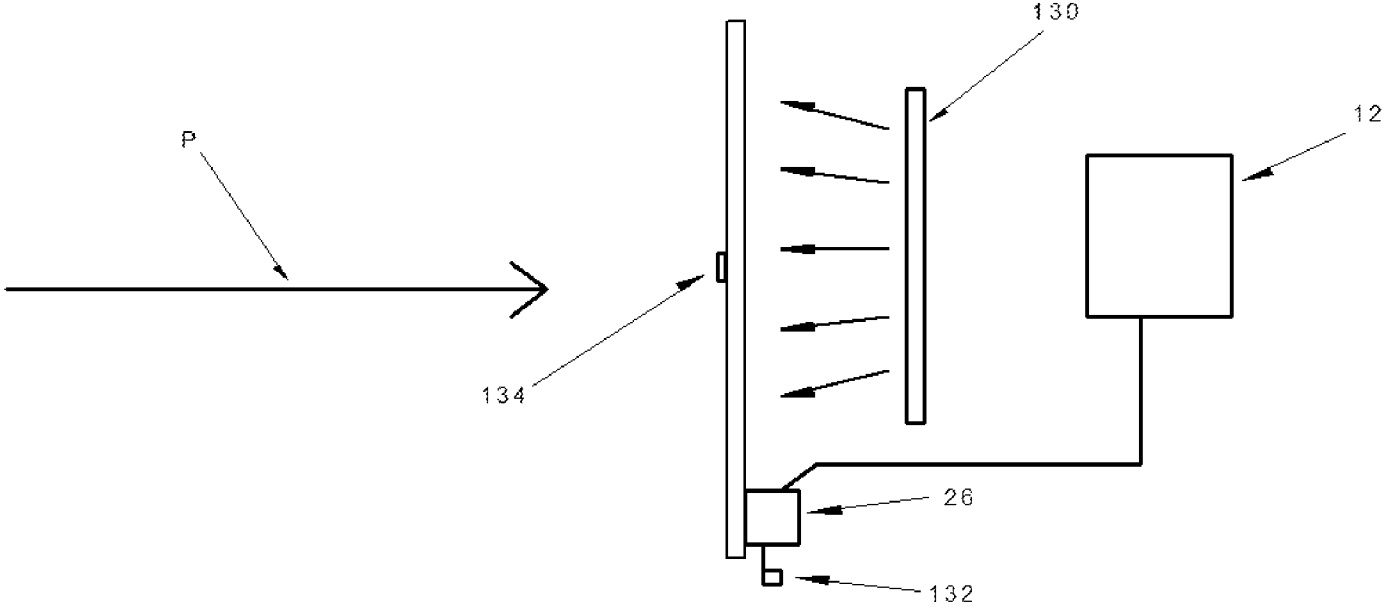
FIG. 10 is a side view of another embodiment of the target of the present invention.

In another embodiment, as illustrated in FIG. 10, a thermal target 130 may be provided. The thermal target 130 may comprise a heater, such as a radiant heater. The thermal target may be indicative of or representative of a human or animal body, producing heat. Use of the thermal target 130 may assist in a training scenario involving a night or dark targeting scenario, such as may be necessary in military training. In such a situation, a shooter may be equipped with a heat-sensing visualization device (not pictured). The thermal target 130 may be activated as a signal of the location of the human or animal.

As is further illustrated in FIG. 10, a hit confirmation flasher 132 may be provided, for displaying feedback to the shooter confirming an accurate strike on the target. A gunfire simulator 134 may also be provided. The gunfire simulator 134 may comprise a flashing light, or may be an intermittent projection of a simulated firing of a gun from the projector 18. In one embodiment, the gunfire simulator and the hit confirmation flasher 132 may be a single unit. The controller 16 may be adapted to control the thermal target 130, the hit confirmation flasher 132, and/or the gunfire simulator.

Figure 11:
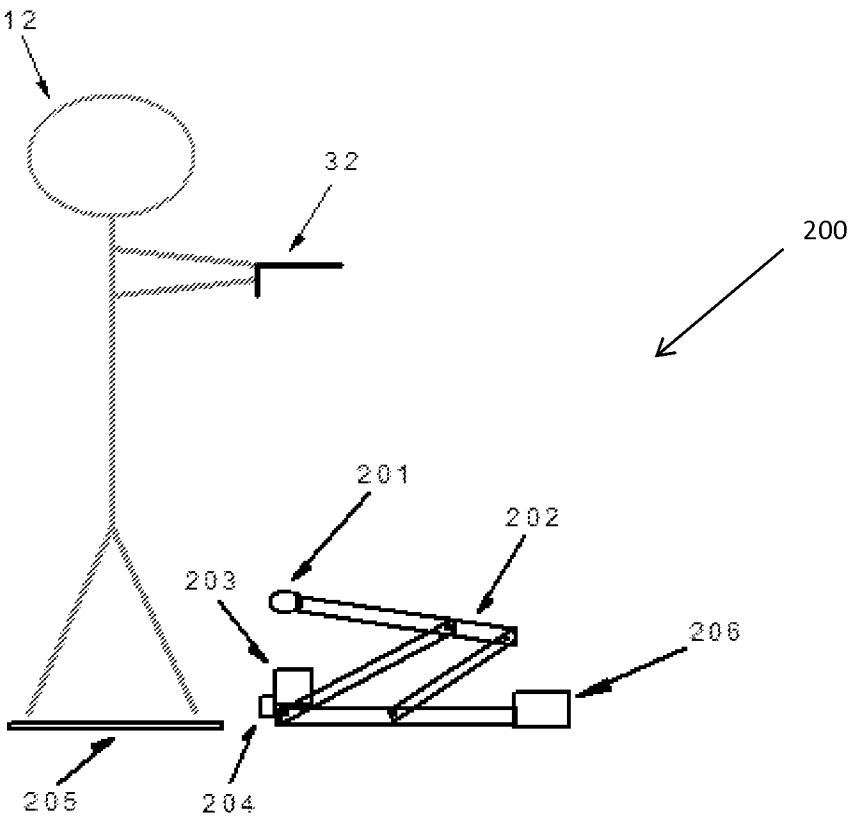
FIG. 11 is a side view of user position alert of the present invention.

In a further aspect of the invention, FIG. 11 illustrates a user position alert 200 of the present invention. The position alert 200 may be adapted to alert the user in the event that he or she has remained in a given position beyond a preset time period. As illustrated, the position alert 200 may include one or more position sensors for sensing a position of the user 12. For instance, the position alert 200 may include a non-contact sensor 204, such as an infrared sensor, an ultrasonic sensor, a proximity sensor, a motion sensor, or any other sensor capable of sensing the presence of the user in a given position. The alert 200 may comprise a pressure sensor 205, such as for sensing a user in contact therewith. One or more of the non-contact sensor(s) 204 and the pressure sensor 205 may be included in the position alert 200.

One or more of the position sensors 204, 205 may be in communication with a processor 206. The processor may be a component of the controller 16, may be independent from the controller 16, and/or may be in communication with the controller 16. In one aspect, the processor 206 may include a timer. The processor 206 may be adapted to receive a signal from the one or more position sensors 204,205 indicating the presence of the user in a given position. The processor 206 may initiate the timer to measure a predetermined time period. This predetermined time period may be an allowable time period before which the user is encouraged to alter his or her position during a training session. The predetermined time period may be set by the user, by a trainer, or may be preset with the position alert 200.

One or more of the position sensors 204,205 may be adapted to sense a change in the user's position, such as when the user moves from a first position to a second position. The one or more position sensors 204,205 may be adapted to send a signal to the processor 206 upon sensing the movement of the user from the first position. Upon receipt of a signal from the position sensor(s) 204,205 that the user has changed position, the processor 206 or the controller 16 may reset the timer and again initiate a countdown of the predetermined time.

At the termination of the predetermined time period, the user may be alerted if he or she has not changed position. For instance, in the event that the one or more position sensors 204,205 has not detected a movement of the user from the position that triggers the timer, an alert may be provided to the user. In the illustrated embodiment of FIG. 11, the user 12 may be alerted via a bumper 201 making contact with the user, such as by making contact with the user's leg. In the event that the position sensor or sensors 204,205 indicate to the processor 206 that the user has remained in a given position for the predetermined time period, the bumper 201 may be activated to contact the user. Contact may be initiated by the processor (and/or the controller 16) triggering a motor 203, such as a hydraulic cylinder, a servomotor or solenoid. The motor 203 may cause the bumper 201 to move, such as through actuation of a mechanical lever 202. The lever 202 may include a spring, a hinge, a rotating shaft, a lever, or any other device capable of inducing a controlled movement of the bumper 201 to make contact with the user.

In one aspect, the bumper 201 may include a sensor for sensing contact, such as with a user. The sensor may be in communication with the processor 206 and/or the controller 16. Upon receipt of an input from the sensor indicating contact by the bumper 201, the movement of the bumper 201 may be stopped and/or reversed.

In another aspect, the position alert 200 may include an auditory signal for alerting the user that a position has been maintained beyond the predetermined time period. The auditory signal may be in communication with the processor 206 and/or the controller 16. Upon indication from the position sensor(s) 204,205 that the user has remained in a given position beyond the predetermined time period, the auditory signal may be adapted to sound. The auditory signal may be provided independent of or in conjunction with the bumper 201.

While the invention has been described with reference to specific examples, it will be understood that numerous variations, modifications and additional embodiments are possible, and all such variations, modifications, and embodiments are to be regarded as being within the spirit and scope of the invention. Also, the drawings, while illustrating the inventive concepts, are not to scale, and should not be limited to any particular sizes or dimensions. Accordingly, it is intended that the present disclosure not be limited to the described embodiments, but that it has the full scope defined by the language of the following claims, and equivalents thereof.

The invention claimed is:

1. A targeting system for use with a projectile weapon for firing a projectile, said system comprising:

at least one target device comprising a non-penetrable solid material, said at least one target device further comprising a vibration sensor and a sonic sensor, each of said vibration sensor and said sonic sensor adapted to detect a projectile strike on said at least one target device:

a light emitter for projecting a light, said light designating a valid target for the projectile;

a controller adapted to control the light emitter to designate said valid target and further adapted to receive a first input from the vibration sensor and a second input from the sonic sensor in response to the projectile strike on the at least one target device, and to calculate an output relating to the impact of the projectile based on both the first input and the second input, thereby allowing for detection of a single impact of the projectile in the context of a double tap.

2. The targeting system of claim 1, wherein the light emitter comprises a laser and the light comprises a focused light beam.

3. The targeting system of claim 1, wherein the light emitter comprises a projector, and wherein the light comprises one of an image or a video.

4. The targeting system of claim 1, wherein the light emitter is further adapted for projecting a second light upon the target, said second light designating an invalid target.

5. The targeting system of claim 4, wherein the output includes a measure of the user's accuracy with respect to hitting the valid target with the projectile and avoiding hitting the invalid target with the projectile.

6. The targeting system of claim 1, further including a position sensor adapted to detect a continued presence of the user in a first position, and an alert for alerting the user in the event the user has remaining in the first position beyond a predetermined time period.

7. The targeting system of claim 1, wherein the vibration sensor comprises a first conductor and a second conductor, and wherein impact of the projectile is detected by contact of the first conductor with the second conductor.

8. The targeting system of claim 7, further including a first timer control circuit for causing the first input from the vibration sensor to the controller to be a first stable pulse electronic signal.

9. The targeting system of claim 8, further including a second timer control circuit for causing the input from the sonic sensor to the controller to be a second stable pulse electronic signal.

10. The targeting system of claim 1, wherein the light comprises a video of a moving object, and wherein the system further comprises an camera for recording said video of said moving object; and a second sensor for sensing an impact of said moving object.

11. The targeting system of claim 1, further including a second light emitter associated with the at least one target device for emitting a second light back to a user of the projectile weapon.

12. The targeting system of claim 11, wherein the controller is adapted to control the second light emitter to emit the second light upon detection of the impact of the projectile.

13. The targeting system of claim 1, wherein the at least one target device comprises a heater.

* * * * *